US011193302B2

(12) United States Patent
Courchaine

(10) Patent No.: US 11,193,302 B2
(45) Date of Patent: Dec. 7, 2021

(54) FENCE BATTEN HAVING PENETRATED ANGULAR SLOTS FOR WIRE RETENTION

(71) Applicant: Tyrell Lee Courchaine, Rigby, ID (US)

(72) Inventor: Tyrell Lee Courchaine, Rigby, ID (US)

( * ) Notice: Subject to any disclaimer, the term of this patent is extended or adjusted under 35 U.S.C. 154(b) by 280 days.

(21) Appl. No.: 16/290,801

(22) Filed: Mar. 1, 2019

(65) Prior Publication Data

US 2019/0271172 A1 Sep. 5, 2019

Related U.S. Application Data

(60) Provisional application No. 62/637,279, filed on Mar. 1, 2018.

(51) Int. Cl.
*E04H 17/12* (2006.01)

(52) U.S. Cl.
CPC ..... *E04H 17/12* (2013.01)

(58) Field of Classification Search
CPC ..... E04H 17/02; E04H 17/04; E04H 17/055; E04H 17/06; E04H 17/10; E04H 17/12; E04H 17/124; B23D 49/003
See application file for complete search history.

(56) References Cited

U.S. PATENT DOCUMENTS 157,124 A 11/1874 Glidden
191,881 A * 6/1877 Plane ..... E04H 17/10 256/48
345,075 A * 7/1886 Quackenbush ..... E04H 17/12 256/58
632,585 A 9/1899 Parker
660,595 A 10/1900 Sheets
695,439 A * 3/1902 Borchers ..... E04H 17/12 256/55
782,121 A * 2/1905 Foreman ..... B23D 49/11 30/503.5
805,785 A 11/1905 Engesetter
(Continued)

FOREIGN PATENT DOCUMENTS

GB 1587441 * 4/1981

OTHER PUBLICATIONS https://www.pinterest.co.uk/pin/83949980523722677/. Feb. 5, 2018.
(Continued)

*Primary Examiner* — Jonathan P Masinick
(74) *Attorney, Agent, or Firm* — Burdick Patents, P.A.; Sean D. Burdick

(57) ABSTRACT

A fence batten is formed from an elongated post having an outer surface surrounding a longitudinal axis. An angled slot is formed through the outer surface of the post. The angled slot defines an upper slot surface and a lower slot surface. The upper slot surface lies in a plane defining an acute angle with respect to the longitudinal axis. A first hole penetrates the outer surface and the upper slot surface, and a second hole concentrically aligned with the first hole penetrates the lower slot surface, so that barbed wire may be pulled into the angled slot and anchored therein by a pin passing through the first and second holes. A system for forming the aforesaid fence batten is also disclosed.

14 Claims, 5 Drawing Sheets

(56) References Cited

U.S. PATENT DOCUMENTS

| | | | | | |
|---|---|---|---|---|---|
| 836,281 | A | * | 11/1906 | Senn | E04H 17/10 256/48 |
| 841,036 | A | * | 1/1907 | Morse | E04H 17/08 52/295 |
| 851,445 | A | | 4/1907 | Seymour | |
| 931,495 | A | | 8/1909 | Saunders | |
| 1,033,617 | A | * | 7/1912 | Reinert | E04H 17/10 256/50 |
| 1,046,676 | A | | 12/1912 | Swenson | |
| 1,049,420 | A | | 1/1913 | Tozzer | |
| 1,050,589 | A | * | 1/1913 | Young | E04H 17/10 256/48 |
| 1,065,471 | A | | 6/1913 | Rohe | |
| 1,117,214 | A | * | 11/1914 | McFarland et al. | E04H 17/10 256/52 |
| 1,158,911 | A | * | 11/1915 | Ferris | E04H 17/10 256/48 |
| 1,179,862 | A | | 4/1916 | Parrish | |
| 1,239,120 | A | * | 9/1917 | Mesecar | E04H 17/10 256/52 |
| 1,264,624 | A | * | 4/1918 | Ephraim | E04H 17/10 256/52 |
| 1,356,970 | A | * | 10/1920 | Clum | E04H 17/12 256/58 |
| 1,565,707 | A | | 12/1925 | Brown | |
| 1,661,528 | A | * | 3/1928 | Dunlap | E04H 17/12 256/58 |
| 2,861,122 | A | | 11/1958 | Flower | |
| 3,606,259 | A | | 9/1971 | Farrell | |
| 4,059,035 | A | * | 11/1977 | Davis | B23D 49/003 83/861 |
| 4,134,575 | A | | 1/1979 | Chavarria | |
| 4,140,036 | A | * | 2/1979 | Davis | B23D 49/003 83/662 |
| 4,266,756 | A | | 5/1981 | Anderson | |
| 4,465,263 | A | | 8/1984 | Robbins, Jr. | |
| 4,510,721 | A | | 4/1985 | Murphy | |
| RE32,707 | E | | 7/1988 | Robbins, Jr. | |
| 5,975,501 | A | | 11/1999 | Berg et al. | |
| 6,105,937 | A | | 8/2000 | Hay | |
| 7,011,269 | B1 | | 3/2006 | Chouinard et al. | |
| 7,188,643 | B1 | | 3/2007 | Lile | |
| 7,195,041 | B2 | | 3/2007 | Lile | |
| 7,290,570 | B1 | | 11/2007 | Spikes | |
| 7,344,122 | B2 | | 3/2008 | Gasaway et al. | |
| 7,866,635 | B2 | | 1/2011 | Payne | |
| 8,540,217 | B2 | | 9/2013 | Olsson et al. | |
| 8,783,661 | B1 | | 7/2014 | Payne | |
| 9,234,367 | B2 | | 1/2016 | Kopp | |
| 9,879,444 | B2 | | 1/2018 | Gibbs et al. | |

OTHER PUBLICATIONS

Conventional Farm Fencing, pp. 1-36. Feb. 5, 2018.
https://www.shutterstock.com/image-photo/female-american-robin-turdus-migratorius-perched-426638446?src=Vsn2in_B2F9ZaUOD7A-17-68. Feb. 5, 2018.
Barbed Wire, p. 1-4. Feb. 5, 2018.
Pacific Northwest Extension Publication. Building an Electric Antipredator Fence. Jul. 2002.
https://www.shutterstock.com/image-photo/barbed-wire-close-background-429381379?src=Vsn2inG7YC_B2F9ZaUOD7A-24-25. Feb. 5, 2018.
https://www.shutterstock.com/image-photo/stake-old-stone-rusty-wire-146479151?src=Vsn2lnG7YC_B2F9ZaUOD7A-37-28. Feb. 5, 2018.
https://www.shutterstock.com/image-photo/ancient-fence-barb-wire-455241901?src=Vsn2lnG7YC_B2F9ZaUOD7A-19-62. Feb. 5, 2018.
Contractor Talk (website, discussion forum). Feb. 5, 2018.
https://www.pinterest.com/pin/99290366760482273/. Feb. 5, 2018.
https://i.ytimg.com/vi/huDMWqpjCII/hqdefault.jpg. Feb. 5, 2018.
https://www.do-it-yourself-help.com/add_electric_wall_outlet.html. Feb. 5, 2018.
http://www.deckmagazine.com/design-construction/railings/installing-cable-railings_o. Feb. 5, 2018.
http://tscra.org/what-we-do/the-cattleman-magazine/ranch-diy-proper-fence-brace-construction/. Feb. 5, 2018.

* cited by examiner

FENCE BATTEN HAVING PENETRATED ANGULAR SLOTS FOR WIRE RETENTION

RELATED APPLICATIONS

This application claims priority to U.S. Provisional Application 62/637,279 which was filed on Mar. 2, 108 and which is fully incorporated herein by reference.

BACKGROUND OF THE INVENTION

Field of the Invention

The present invention relates generally to wire fences, and more specifically to a fence post or batten having specialized structure for retaining wire.

Description of Related Art

Wire fences, such as barbed wire fences, date back to 1867, to U.S. Pat. No. 66,182 granted to Lucien B. Smith, and notably, to an improvement in the barb design described in U.S. Pat. No. 157,124 granted to Joseph Glidden in 1874. Since that time, many improvements have been made in structural designs and in manufacturing methods for fence posts and for various styles of wire that are stretched between the posts to form a fence.

One style of wire fence that is commonly used to define range limits for open range livestock is known as the "multi-wire, multi-batten" or "post and batten" fence. This type of fence typically consists of a series of posts horizontally spaced about 12 to 15 feet apart, three to five battens equally spaced between each adjacent pair of posts, and about five to ten wire strands each vertically spaced apart and strung transversely across the posts and battens. The posts are sunk into the ground to provide anchoring points along the length of the fence. The battens (also known as "staves" or "dancers" or "droppers") rest on the ground, and provide wire attachment points to maintain desired spacing between the wires and preserve the overall integrity of the fence. The posts and battens are formed from wood, metal, or plastic. Wooden posts and battens are most commonly used to fence vast, rural or remote areas such as those bordering open range or national forests. Because battens are not designed to be driven below ground, they are particularly useful in terrain that is rocky or marshy or riddled with tree roots or other subterranean obstructions.

When constructing a post and batten fence, one of the most time-consuming tasks involves attaching each wire to each and every post and batten that the wire intersects. Methods and hardware for accomplishing this task range from simple to complex. Toward the simpler end of the spectrum, a staple may be driven into a wooden post or batten to secure the wire at each intersection. More complex solutions involve fastening the wire around notches or catches specially formed in the post or batten, or forming specialized hardware such as hooks or brackets that lock the wire to the post or batten.

While these solutions may be structurally effective, there remains a need to further simplify the wire attachment process, particularly when constructing fences that run for many miles into remote areas, to allow the job to be completed as quickly and efficiently as possible.

SUMMARY OF THE INVENTION

The present invention provides an elegant design for a fence batten characterized by a post having penetrated angular slots for wire retention that allow for faster and more efficient construction of wire fences. In one embodiment of the invention, a fence batten is formed from an elongated post having an outer surface surrounding a longitudinal axis. One or more angled slots are formed along the length of the post through the outer surface of the post. Each angled slot defines an upper slot surface and a lower slot surface. For each angled slot, the upper slot surface lies in a plane defining an acute angle with respect to the longitudinal axis. At each angled slot, a first hole penetrates the outer surface and the upper slot surface, and a second hole concentrically aligned with the first hole penetrates the lower slot surface, so that wire such as barbed wire may be pulled into the angled slot and anchored therein by a pin passing through the first and second holes.

In an embodiment of a related invention, a system for forming the aforesaid fence batten is also disclosed. The system includes a plurality of saw blades maintained in a spaced-apart relationship, wherein each of the saw blades is coupled to a common means for linear translation of the saw blades. Each saw blade is tilted at a same angle with respect to horizontal. The system is thus configured so that the saw blades, when translated by the common means into the post lying horizontally in a linear path of the saw blades and approximately equidistant from each of the saw blades, will cut a plurality of angled slots through an outer surface of the post. The angled slots cut in this manner are spaced apart according to the spaced-apart relationship of the saw blades. Each angled slot cut in this manner defines an upper slot surface and a lower slot surface, wherein for each angled slot the upper slot surface lies in a plane defining the same angle with respect to a horizontal axis of the post.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments for a fence batten according to the invention. Generally, the invention is characterized by its formation as an elongated post having spaced apart, penetrated angular slots for wire retention that allow for faster and more efficient construction of wire fences. While the following disclosure presents an exemplary embodiment of the invention in the form of a fence batten that is designed to rest on the ground, the principles of the invention apply equally to a post designed to be sunk into ground, or otherwise secured to the ground or to another base or structure.

Figure 1:
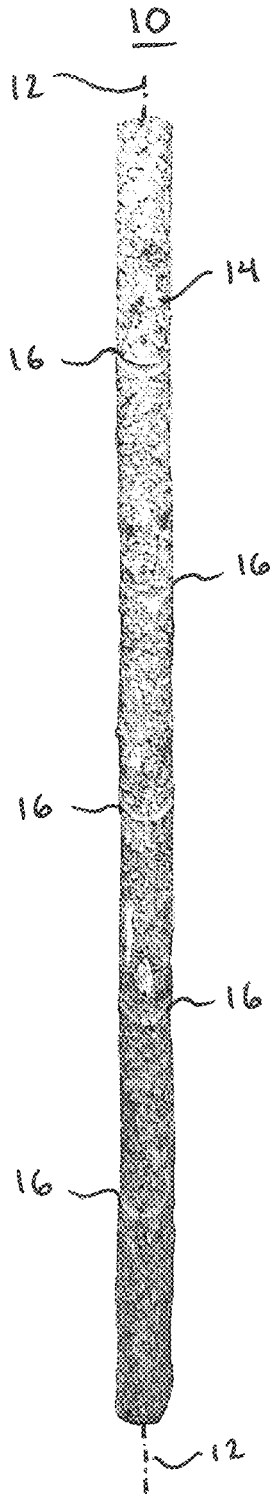
FIG. 1 is a frontal view of one embodiment of a fence batten formed according to the invention.

FIG. 1 shows a frontal view of one embodiment of a fence batten 10 formed according to the invention. The image is a grayscale photograph of a prototype manufactured by the present inventor. The fence batten 10 may be formed from an elongated post, made from any suitable rigid material such as wood, metal, or certain plastics. The fence batten 10 shown here is generally cylindrical, and formed from a section of softwood round timber, having a length between about four feet and about six feet, and a diameter between about 2.25 in. and about 2.75 in. Accordingly, in one embodiment, the diameter or cross-sectional area of the fence batten 10 may be between about 4 square inches and about 6 square inches. Longer or shorter lengths for the batten, and greater or lesser diameters or widths are also possible within the scope of the invention. Geometric configurations other that cylindrical are also possible, as battens and posts according to the invention may be made to have circular, triangular, oval, or other cross-sectional shapes.

Fence batten 10 may be further characterized as defining an imaginary longitudinal axis 12 that runs vertically through the center of the post, as shown in FIG. 1. An outer surface 14 surrounds the volume of the fence batten 10 about its perimeter, and therefore also surrounds the longitudinal axis 12. One or more angled slots 16, for accommodating fence wire, such as barbed wire under tension, are formed through the outer surface 14 at intervals along the length of the fence batten 10.

Figure 2:
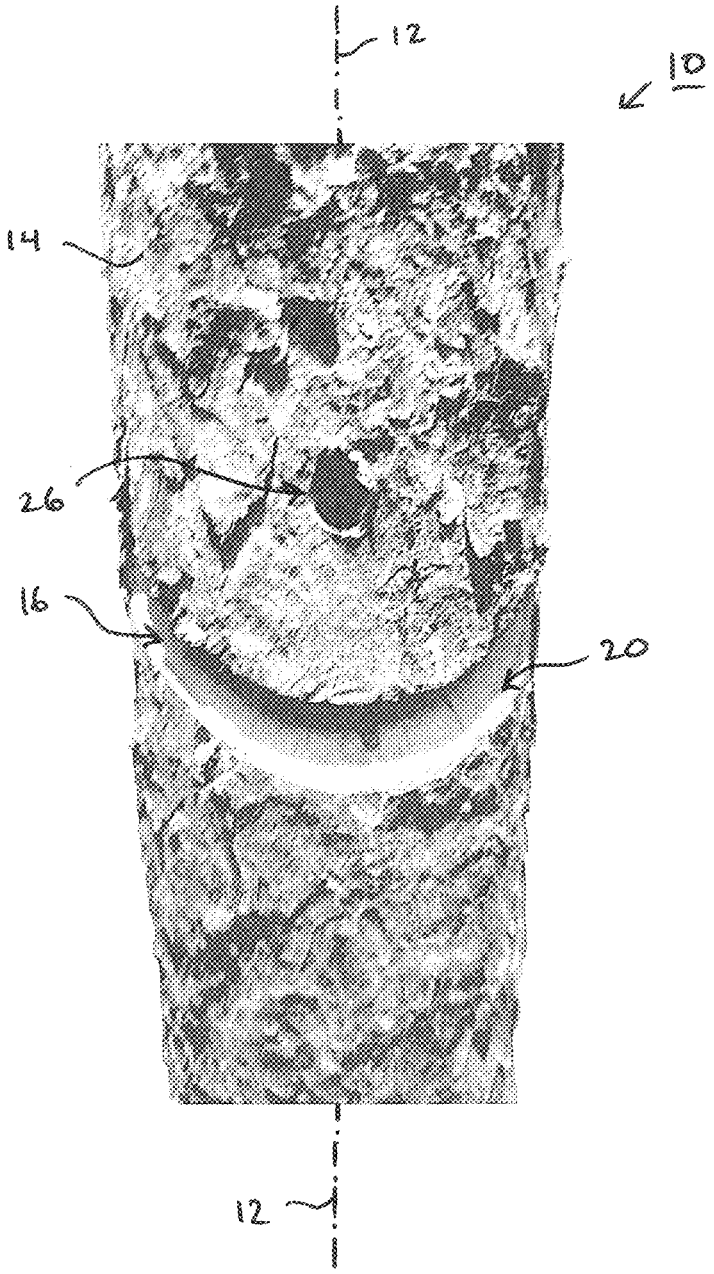
FIG. 2 is a magnified front view of an angled slot formed in the fence batten of FIG. 1.

FIG. 2 shows a magnified frontal view of an angled slot 16 formed in fence batten 10. The angled slot 16 defines an upper slot surface 18 and a lower slot surface 20 (see also FIG. 5). The upper slot surface 18 lies substantially within a plane 22 that defines an acute angle A with respect to longitudinal axis 12. The lower slot surface 20 also lies substantially within a plane 24 and defines a similar angle A with respect to the longitudinal axis 12. A first hole 26 penetrates the outer surface 14 and the upper slot surface 18.

Figure 3:
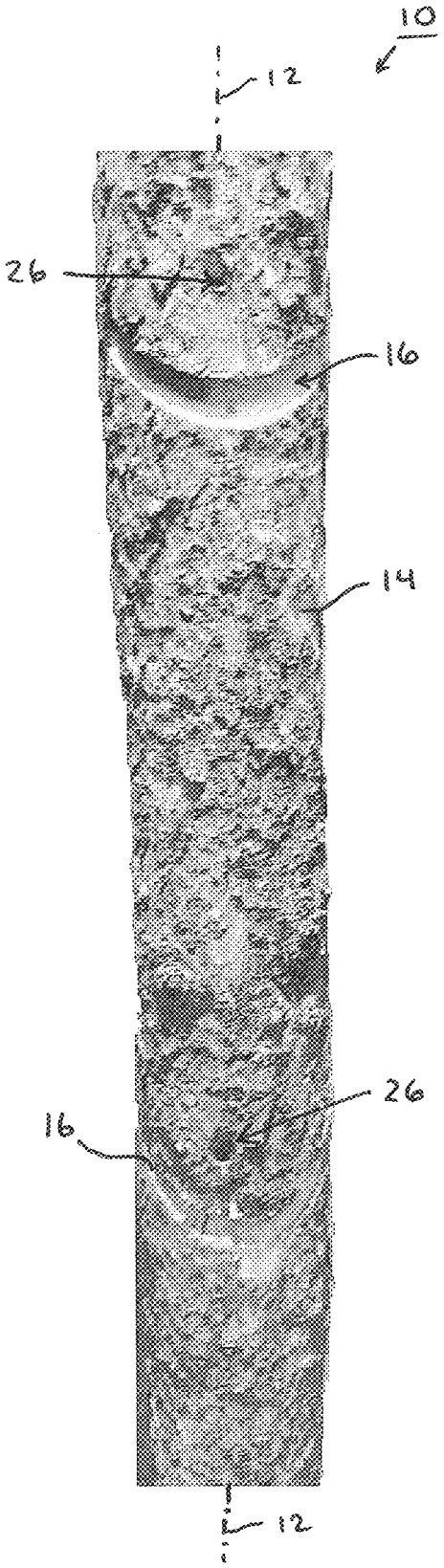
FIG. 3 is another magnified frontal view of the fence batten of FIG. 1, showing two adjacent angled slots.

FIG. 3 shows another magnified frontal view of fence batten 10, to illustrate the concept of adjacent angled slots 16. Each angled slot 16 defines an upper slot surface 18 and a lower slot surface 20. In one embodiment, the distance between any two adjacent angled slots 16 is approximately 10 inches.

Figure 4:
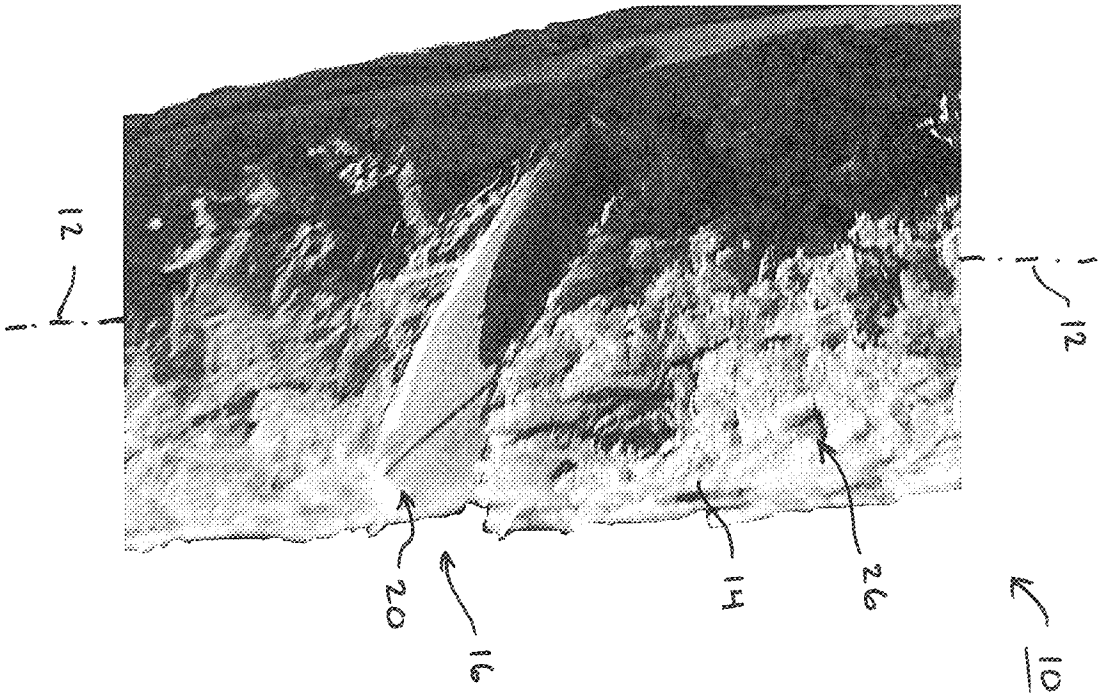
FIG. 4 is a close-up side view of an angled slot formed in the fence batten of FIG. 1.

FIG. 4 shows a close-up side view of an angled slot 16 formed in the fence batten 10. This view illustrates the acute angle defined by the lower slot surface 20 with respect to the longitudinal axis of the fence batten 10.

Figure 5:
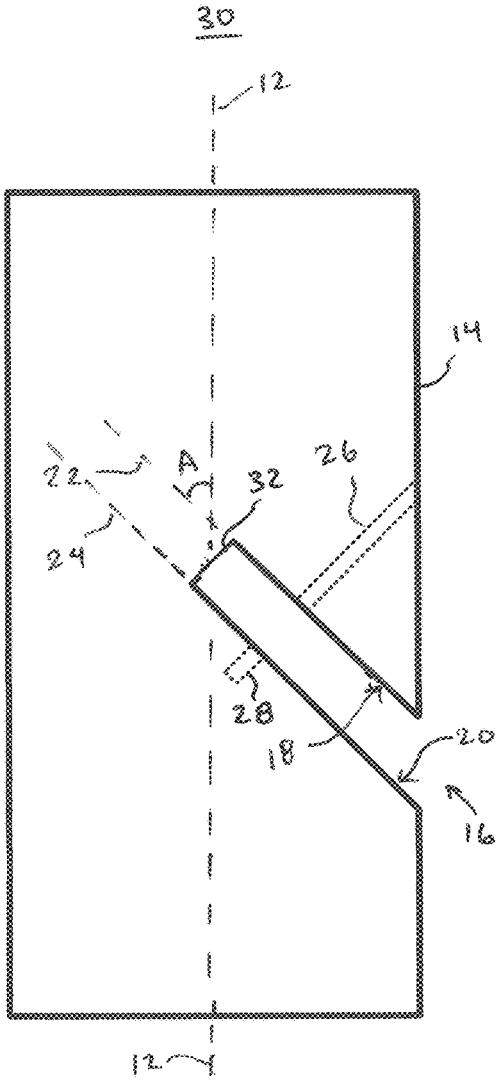
FIG. 5 is a side view of another embodiment of a fence batten according to the invention, showing concentrically aligned first and second holes penetrating, respectively, an upper slot surface and a lower slot surface.
Figure 6:
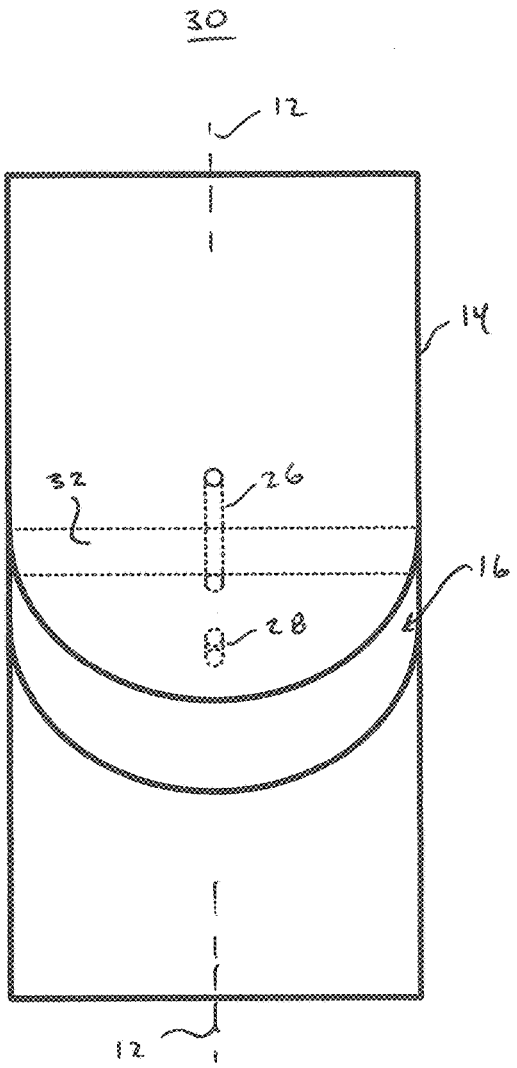
FIG. 6 is a frontal view of the fence batten of FIG. 5.

FIGS. 5 and 6 present a preferred configuration for penetrating an angular slot 16 of a fence batten 30 according to another embodiment of the invention. FIG. 5 shows a side view of the fence batten 30 and FIG. 6 shows a frontal view thereof. These figures illustrate how the angular slot 16 may be penetrated by one or more holes—a first hole 26 or a second hole 28, or both. According to the invention, penetration of an angular slot 16 by a first hole 26 or by a second hole 28 means that the hole 26 or 28 is formed through a surface defined by the angular slot 16. For example, first hole 26 penetrates the angular slot 16 because first hole 26 is formed through the upper slot surface 18 and thereby provides a passage into the void defined by the angular slot. Similarly, second hole 28 penetrates the angular slot 16 because second hole 28 is formed through the lower slot surface 20, thereby providing a passage into the same void. First hole 26 may also penetrate the outer surface 14, as shown. In one embodiment, one or both of holes 26, 28 are formed along an axis that is oriented substantially normal to the upper slot surface 18 or to the lower slot surface 20. In other embodiments, an axis of one or both of the holes 26, 28 may form an angle other than 90 degrees with respect to one or both of the upper and lower slot surfaces 18, 20. In another embodiment, the first hole 26 and the second hole 28 are substantially concentrically aligned along an axis of penetration that is substantially normal to the upper slot surface 18 or to the lower slot surface 20, as shown. In another embodiment, first hole 26 is the only hole provided for penetrating a particular angled slot 16. In another embodiment, second hole 28 is the only hole provided for penetrating a particular angled slot 16.

According to the invention, an angular slot 16 may also be configured with an inner surface 32 that extends between the upper slot surface 18 and the lower slot surface 20. The inner surface 32 forms an inner wall at the interior-most extent of the slot. In one embodiment, the inner surface 32 is located so that at least one point on the inner surface 32 intersects the longitudinal axis 12. For example, the fence batten 30 may be configured so that a point coincident with the geometric center of inner surface 32 also lies on the longitudinal axis 12. The inner surface 32 may be planar or curved or jagged, and may extend substantially perpendicularly from the upper slot surface 18 to the lower slot surface 20, or define an angle other than 90 degrees with respect to surface 18 or 20.

Another aspect of the invention provides a method and system for manufacturing a fence batten having any of the various configurations described above. One such system for manufacturing a fence batten from a post includes a plurality of saw blades maintained in a spaced-apart relationship. The saw blades may be powered by conventional sawing apparatus known in the art but integrated within the present system. In one embodiment each of the saw blades is coupled to a common means for linear translation of the saw blades, while each saw blade is tilted at a same angle with respect to horizontal. The tilt angle of the saw blades corresponds to the desired angle to be defined, by an angled slot 16, with respect to a longitudinal axis 12 of the finished fence batten. The system may be further configured so that the saw blades, when translated by the common means into the post lying in a linear path of the saw blades and approximately equidistant from each of the saw blades, will cut a plurality of angled slots 16 through an outer surface 14 of the post, so that the angled slots so formed will be spaced apart according to the spaced-apart relationship of the saw blades. After the cut, each angled slot 16 will define an upper slot surface 18 and a lower slot surface 20, wherein for each angled slot 16 the upper slot surface 18 lies in a plane defining the same angle with respect to a longitudinal axis 12 of the post.

A system according to the invention may further comprise a means for drilling a hole through the outer surface 14 of the post to at least one upper slot surface, so that the hole will be concentrically aligned along an axis of penetration that is substantially normal to the at least one upper slot surface. The drilling means may comprise conventional drilling apparatus known in the art but integrated within the present system. In one embodiment, the drilling means may comprise a drill bit configured for being repositioned to drill the hole to an upper slot surface of any one of the angled slots. In another embodiment, the drilling means may comprise a plurality of drill bits, each configured to drill a hole through the outer surface of the post to an upper slot surface of one of the angled slots.

In operation, when building a wire fence such as a post and batten fence, posts or fence battens manufactured according to the principles of the present invention may be used advantageously as follows: After the post or batten is secured to or placed at its desired location along the fence line, with one or more strands of fence wire (such as barbed wire) made available for attachment to the post or batten, a worker may grasp a single strand of the wire and pull or push the wire into a desired angled slot 16, to the rear of the slot so that the wire rests between the inner surface 32 and the opening of hole 26 or 28. With the wire maintained at that position, the worker may then insert a pin (or dowel, nail, length of surplus wire, or the like) through the first hole 16 and into the second hole 28. The wire is thereby attached.

The pin should be selected so that its length exceeds the height of the angled slot 16, i.e., the distance from the lower slot surface 20 to the upper slot surface 18. In an embodiment of the invention in which, with the post or batten standing erect in an installed position, the upper slot surface 18 slants upward from the outer surface 14 to the inner surface 32, the pin inserted through the first and second holes 26, 28 will remain in place under force of gravity and prevent the fence wire from sliding out of the angled slot 16, thus retaining the wire within the slot. While it is preferred to configure the post or batten with first and second holes 26 and 28, the same retention effect may be achieved with only a single penetrating hole. For example, where only the first hole 26 is formed, a pin or nail may be pushed through the hole with sufficient force to imbed the end of the pin in the lower slot surface. Where only the second hole 28 is formed, the hole may be located within the slot 16 and nearer to the outer surface 14 so that a pin or nail may be inserted through the opening of slot 16 and into the hole, to guard against the fence wire sliding out.

The relatively simple procedure described in the foregoing paragraphs underscores an advantage of the invention. The invention allows for reliable attachment of fence wire to posts and battens without the use of specialized tools or hardware—in fact, the attachment can be done entirely by hand. A further advantage of the invention is that it enables wire fences to be constructed with greater speed and efficiency than what can be achieved with prior designs. Another advantage of the invention is that it simplifies the manufacturing process for posts and battens, which need only minor modifications, i.e., cutting the angled slots and drilling the penetration holes.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A fence batten, comprising:

an elongated post having an outer surface surrounding a central longitudinal axis;

an angled slot formed through the outer surface of the post, the angled slot defining an upper slot surface and a lower slot surface, the upper slot surface lying in a plane defining an acute angle with respect to the longitudinal axis;

an inner surface extending between the upper slot surface and the lower slot surface; and a first hole penetrating the outer surface and the upper slot surface;

wherein, with the post standing erect in an installed position, the upper slot surface slants upward from the outer surface to the inner surface so that a pin inserted through the first hole will remain in place under force of gravity and prevent fence wire resting between the inner surface and the inserted pin from sliding out of the angled slot thereby retaining the fence wire within the angled slot.

2. The fence batten of claim 1 wherein the first hole has a diameter of approximately one-quarter inch.

3. The fence batten of claim 1 wherein the first hole is concentrically aligned along an axis of penetration that is substantially normal to the upper slot surface.

4. The fence batten of claim 1, further comprising a second hole penetrating the lower slot surface.

5. The fence batten of claim 4, wherein the first hole and the second hole are concentrically aligned.

6. The fence batten of claim 1, wherein the angled slot has a height between the upper slot surface and the lower slot surface sufficient to accommodate 12.5 nominal gauge barbed wire.

7. The fence batten of claim 6 wherein the height of the angled slot is about one-quarter inch.

8. The fence batten of claim 1, wherein a point on the inner surface approximately midway between the upper slot surface and the lower slot surface intersects the central longitudinal axis.

9. The fence batten of claim 1 wherein the outer surface has a longitudinal length between about 4 feet and about 6 feet.

10. The fence batten of claim 1 wherein the post is formed from a round length of softwood.

11. The fence batten of claim 1 wherein an average cross sectional area of the post is between about 4 square inches and about 6 square inches.

12. The fence batten of claim 1 wherein the acute angle is approximately 45 degrees.

13. The fence batten of claim 1 further comprising a plurality of longitudinally spaced angled slots formed in the post, each angled slot defining an upper slot surface and a lower slot surface, wherein for each angled slot the upper slot surface lies in a plane defining an acute angle with respect to the longitudinal axis.

14. The fence batten of claim 13 wherein any two adjacent angled slots are spaced apart by approximately ten inches.

* * * * *